US010227748B2

(12) United States Patent
McMillan

(10) Patent No.: US 10,227,748 B2
(45) Date of Patent: Mar. 12, 2019

(54) TOOTH ATTACHMENT FOR A DRILL AND A DRILL INCORPORATING THE SAME

(71) Applicant: Jaron Lyell McMillan, Christchurch (NZ)

(72) Inventor: Jaron Lyell McMillan, Christchurch (NZ)

( * ) Notice: Subject to any disclaimer, the term of this patent is extended or adjusted under 35 U.S.C. 154(b) by 0 days.

(21) Appl. No.: 15/560,498

(22) PCT Filed: Mar. 30, 2016

(86) PCT No.: PCT/IB2016/051780

§ 371 (c)(1),
(2) Date: Sep. 22, 2017

(87) PCT Pub. No.: WO2016/162776

PCT Pub. Date: Oct. 13, 2016

(65) Prior Publication Data

US 2018/0058028 A1 Mar. 1, 2018

(30) Foreign Application Priority Data

Apr. 9, 2015 (NZ) ..... 706811

(51) Int. Cl.

| | |
|---|---|
| ***E02D 5/36*** | (2006.01) |
| ***E21B 7/20*** | (2006.01) |
| ***E21B 10/44*** | (2006.01) |
| ***E21B 10/26*** | (2006.01) |

(Continued)

(52) U.S. Cl.

CPC ..... *E02D 5/36* (2013.01); *E02D 5/66* (2013.01); *E21B 7/20* (2013.01); *E21B 10/26* (2013.01);

(Continued)

(58) Field of Classification Search

CPC .... E02D 5/34; E02D 5/36; E02D 5/56; E02D 7/22; E21B 10/43; E21B 10/44; E21B 2010/425; E21B 7/201; E21B 7/005

(Continued)

(56) References Cited

U.S. PATENT DOCUMENTS

| | | | |
|---|---|---|---|
| 79,356 | A * | 6/1868 | Jordan |
| 3,375,890 | A | 4/1968 | Petersen |

(Continued)

FOREIGN PATENT DOCUMENTS

| | | |
|---|---|---|
| GB | 2503918 | 1/2014 |
| JP | A1988078918 | 4/1988 |
| WO | WO1994002687 | 2/1994 |

*Primary Examiner* — Sunil Singh
(74) *Attorney, Agent, or Firm* — Galbreath Law Offices, P.C.; John A. Galbreath

(57) ABSTRACT

A drill unit for forming a column in ground which includes an outer drill and a concentric inner drill, where attached to the outer drill there is at least one drill tooth which includes a first face, a second face and a base face wherein: —the first face and the second face are immediately adjacent one another and are coterminous at a first edge and a second edge; —the base face is the face closest to, or coterminous with, the first terminal end; —all faces, except the base face, are independently coterminous with the base face; and extend away from the base face in the same direction; —at least part of the at least one drill tooth extends away from the first terminal end to terminate at the second edge; —the second edge is the edge of the at least one tooth that is most longitudinally distant from the first terminal end; —the first face further includes a first alpha edge, where the first alpha edge is an edge of the first face opposite the first edge; —a line joining the first edge and the first alpha edge, where the first face and the base face are coterminous, a first face alignment line, is at an angle of Φ to a perpendicular extending from the first outside surface; —the second face (Continued)

further includes a second alpha edge which is an edge of the second face opposite the first edge; and —a line joining the first edge and the second alpha edge, where the second face and the base face are coterminous, a second face alignment line, is at an angle of θ to a tangent on the first outside surface; such that, when in use forming the column, the first edge is configured to be a leading edge.

19 Claims, 9 Drawing Sheets

(51) Int. Cl.

| | |
|---|---|
| ***E21B 10/64*** | (2006.01) |
| ***E02D 5/66*** | (2006.01) |
| ***E21B 10/62*** | (2006.01) |
| *E21B 7/02* | (2006.01) |

(52) U.S. Cl.
CPC ..... *E21B 10/44* (2013.01); *E21B 10/62* (2013.01); *E21B 10/64* (2013.01); *E21B 7/02* (2013.01)

(58) Field of Classification Search
USPC ..... 405/240–243; 175/323, 257, 394; 37/448, 452
See application file for complete search history.

(56) References Cited

U.S. PATENT DOCUMENTS

| | | | | |
|---|---|---|---|---|
| 3,507,124 | A * | 4/1970 | Turzillo | E02D 5/36 405/241 |
| 3,886,754 | A * | 6/1975 | Turzillo | E02D 5/36 405/239 |
| 4,087,131 | A * | 5/1978 | Peterson | E21C 27/22 175/394 |
| 4,100,750 | A * | 7/1978 | Labrue | E02D 5/385 405/241 |
| 6,033,152 | A | 3/2000 | Blum | |
| 2006/0060386 | A1 | 3/2006 | Reich | |
| 2012/0213596 | A1 | 8/2012 | Neville | |

* cited by examiner

TOOTH ATTACHMENT FOR A DRILL AND A DRILL INCORPORATING THE SAME

TECHNICAL FIELD

The present invention relates to a 'tooth' attached to a drill unit used to form piles or granular/bonded stone columns. Each 'tooth' is attached to the drill unit or a flight on a drill unit close to or at the leading edge of the flight. The 'tooth' is particularly suitable for a drill unit which includes concentric inner drill and outer drills used to form bonded or un-bonded granular stone columns, or a tubular drill, which can feed material through a central longitudinal void or cavity. The invention also relates to a drill unit incorporating said tooth or teeth.

BACKGROUND ART

Any discussion of the prior art throughout the specification is not an admission that such prior art is widely known or forms part of the common general knowledge in the field.

It has been found that a granular stone column can be formed reliably by using a drill unit with concentric inner and outer drills, the outer drill including a cavity in which the inner drill lies. Drills of this type are described in JP 62-228514, JP 59-141622, JP02-167918, WO2010/029871 or the applicant's own invention described in PCT/IB2012/051585. The inner drill feeds the granular material used to form the column out of an open end of the outer drill as the stone column drill is extracted from the ground. The feed rate of the stone column drill and inner drill can be adjusted to vary the properties of the column formed, but, there are limits to this approach and some granular material can move, or be forced, inwardly depending on the feed rates, rotational directions and speeds of the inner and outer drills. If some granular material does move inwardly, or against the direction of flow of the bulk material, then this can detrimentally affect the quality of the granular stone column formed and/or increase the likelihood of bridging occurring and/or reduce the feed rate of granular material into the column through the drill unit.

It is possible to reduce or eliminate the chances of bridging and modify the characteristics of the granular stone column formed by using the applicant's invention described in PCT/IB2013/091395 but this can add to the cost of the stone column drill and may still not prevent some granular material moving inwardly, slowly or against the bulk direction of flow of the granular material.

When installing a group of columns in close proximity in ground susceptible to liquefaction, or consisting of a fluid soil, as more columns are installed the ground appears to pressurise and this can prevent the column material from being fed properly or successfully compacted.

DISCLOSURE OF INVENTION

It is an object of the present invention to provide a 'tooth' for a column drill or soil displacement auger that ameliorates at least one of the defects of previous designs, or at least provides the consumer with a useful choice.

The present invention provides a drill unit for forming a column in ground which includes an outer drill, where:

- the outer drill is a tube which includes a first cavity, a first outside surface and a first terminal end;
- the first cavity is an interior void extending along the outer drill which, in use, provides a pathway for material used to form the column to exit at the first terminal end;

- the first outside surface is an exposed outer surface of the outer drill; and
- the first terminal end of the outer drill is the terminal end of the outer drill that, when the drill unit is in use, enters, or is within, the ground;

such that attached to the outer drill there is at least one drill tooth which includes a first face, a second face and a base face wherein:

- the first face and the second face are immediately adjacent one another and are coterminous at a first edge and a second edge;
- the base face is the face closest to, or coterminous with, the first terminal end;
- all faces, except the base face, are independently coterminous with the base face; and extend away from the base face in the same direction;
- at least part of the at least one drill tooth extends away from the first terminal end to terminate at the second edge;
- the second edge is the edge of the at least one tooth that is most longitudinally distant from the first terminal end;
- the first face further includes a first alpha edge, where the first alpha edge is an edge of the first face opposite the first edge;
- a line joining the first edge and the first alpha edge, where the first face and the base face are coterminous, a first face alignment line, is at an angle of $\phi$ to a perpendicular extending from the first outside surface;
- the second face further includes a second alpha edge which is an edge of the second face opposite the first edge; and
- a line joining the first edge and the second alpha edge, where the second face and the base face are coterminous, a second face alignment line, is at an angle of $\theta$ to a tangent on the first outside surface;

such that, when in use forming the column, the first edge is configured to be a leading edge.

Preferably there are at least two drill teeth. In a highly preferred form there are from 2 to 12 drill teeth present. Preferably there are 2 to 6 drill teeth.

Preferably the at least one drill tooth is attached to an outer flight, where the outer flight is attached to the first outside surface. Preferably there are from 1 to 6 outer flights.

Preferably the at least one drill tooth is attached to an outrigger, where the outrigger is attached to the first outside surface. Preferably, when in use, the first edge is a leading edge of the drill tooth as the drill unit is inserted.

Preferably the first face lies on a plane parallel to a longitudinal axis of the outer drill.

Preferably the first face is planar. In an alternative configuration the first face is curved in at least one dimension. In a further alternative form the first face is curved in more than one dimension. Preferably the second face is planar. In an alternative configuration the second face is curved in at least one dimension. In a further alternative form the second face is curved in more than one dimension.

In an alternative preferred form the first face lies on a plane which is at an angle $\alpha$ to a line parallel to a longitudinal axis of the outer drill. Preferably angle $\alpha$ is between 45° and −45°, or any angular range within this range.

Preferably $\phi$ is from around 15° to 80°, or any angular range within this range.

Preferably $\theta$ is from around 1° to 10°, or any angular range within this range.

Preferably at least one drill tooth is permanently attached. In a further preferred form at least one drill tooth is releasably attached.

Preferably, where an outer drill flight exists there is one drill tooth attached to each first flight terminal end. In an alternative preferred form the drill tooth is directly or indirectly, permanently or releasably, attached to the first outside surface. In one form at least one tooth is attached to an outrigger extending from the outer drill.

Preferably the drill unit includes an inner drill lying at least partially within the first cavity. Preferably, where an inner drill is present, the inner drill is an auger with an inner flight, where the inner flight is the auger flight.

Preferably at least one drill tooth is configured to guide material used to form a stone column radially outwards from the inner drill.

Preferably, where an outer flight is present, the drill tooth is attached to, or associated with, that outer flight, in the angled position, extends at least 50% of the full width of the outer flight.

Where an outer flight is not present, the length of the first face is preferably, where D is the diameter of the outer drill:

for an outer drill up to 500 mm in diameter, a minimum of 0.2 D and a maximum of 1.5 D; and for an outer drill over 500 mm, a minimum of 200 mm and a maximum of 0.5 D.

Preferably for outer drills below 250 mm in diameter the minimum length of the first face is between 0.33 D to 0.6 D.

Preferably the longitudinal separation between the first terminal end and the second edge is:

for an outer drill diameter, D, of up to 500 mm from 0.2 D to 500 mm, and for an outer drill diameter, D, over 500 mm between 100 mm and D.

Preferably for outer drills below 250 mm in diameter the minimum longitudinal separation is between 0.33 D to 0.6 D rather than 0.2 D.

The present invention also includes a drill tooth for use with a drill unit where the drill tooth includes a first face, a second face and a base face such that:

the first face and the second face are immediately adjacent one another and are coterminous at a first edge;

all faces, except the base face, are independently coterminous with the base face; and extend away from the base face in the same direction;

the second edge is the edge of the drill tooth most longitudinally distant from the base face;

the first face includes a first alpha edge where the first alpha edge is an edge of the first face opposite to the first edge;

the drill tooth further includes a first face alignment line which is a line joining the first edge and the first alpha edge where the first face and the base face are coterminous;

the second face includes a second alpha edge which is an edge of the second face opposite the first edge;

the drill tooth further includes a second face alignment line which is a line joining the second alpha edge and the first edge where the second face and the base face are coterminous;

the first face is planar or convex;

the second face is planar or concave; and the angle between the first face alignment line and the second face alignment line is a minimum of 0° and a maximum of 74° (or any angular range within this range i.e. the first angle can be anything from 0° to 74° and the second angle can be anything from 0° to 74°).

Preferably the base face is a quadrilateral with zero or more curved edges.

Preferably the first and/or second faces are curved. Preferably the first and/or second face is planar. Preferably there are one or more faces between the first trailing edge and the second trailing edge.

Preferably at least one drill tooth is configured to guide material used to form a stone column radially outwards from the inner drill.

BRIEF DESCRIPTION OF DRAWINGS

By way of example only, a preferred embodiment of the present invention is described in detail below with reference to the accompanying drawings, in which.

Figure 7:
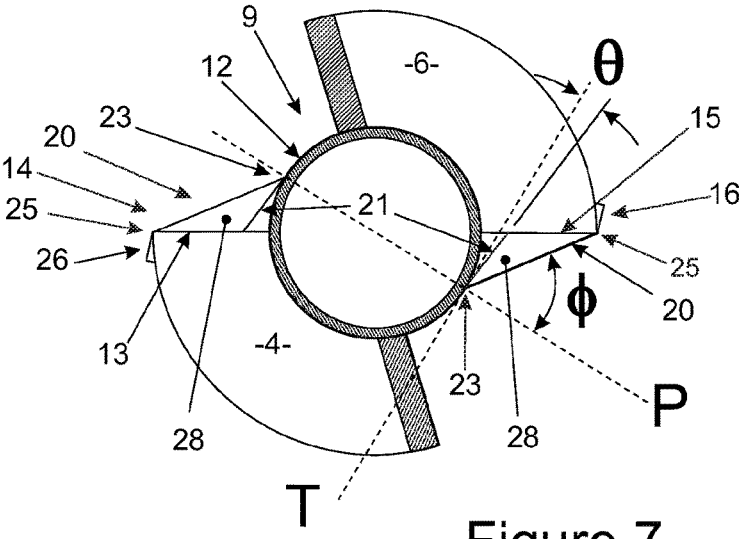
Figure 8:
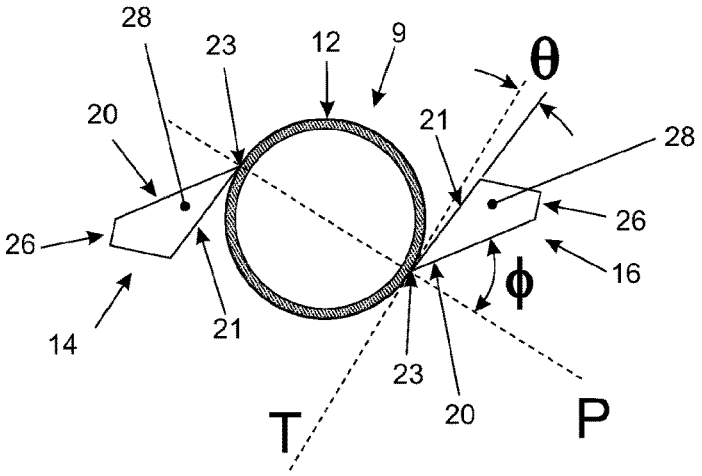
Figure 9:
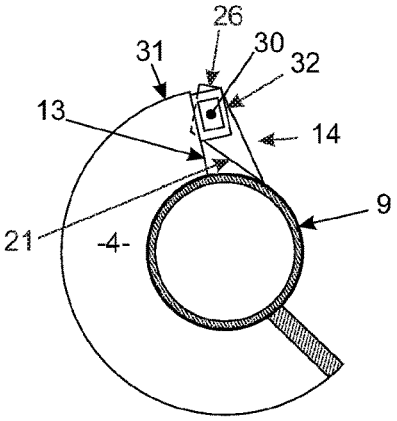
Figure 10:
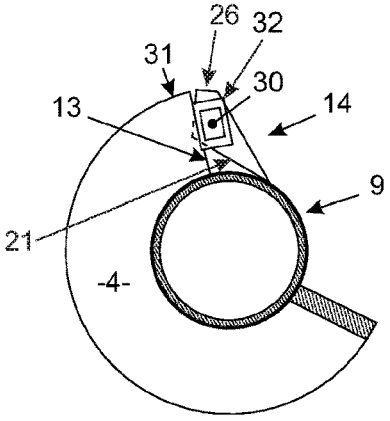
Figure 11:
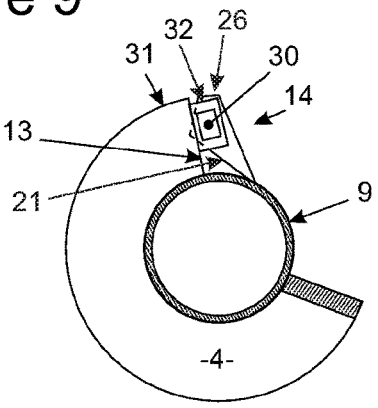
Figure 12:
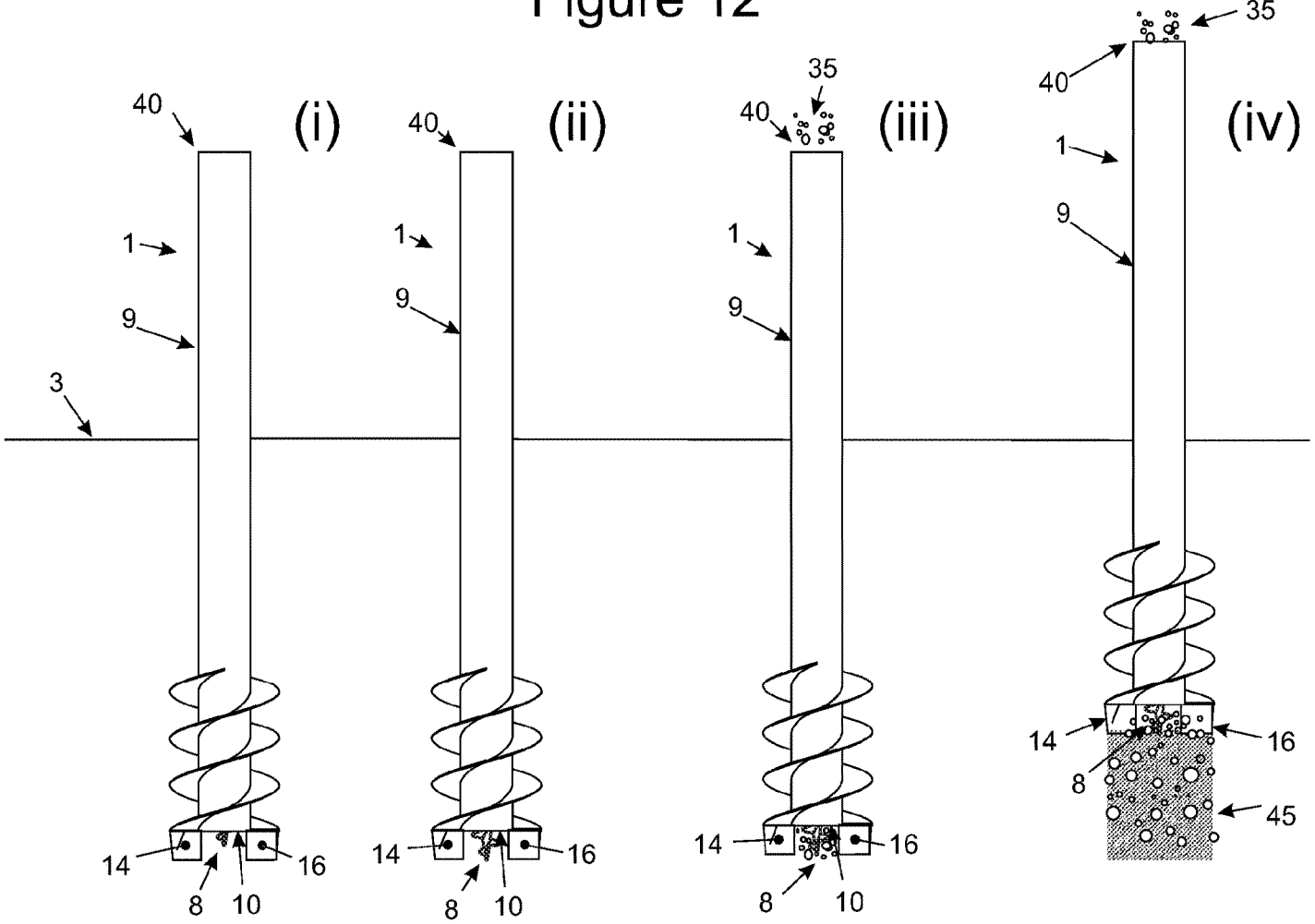
Figure 13:
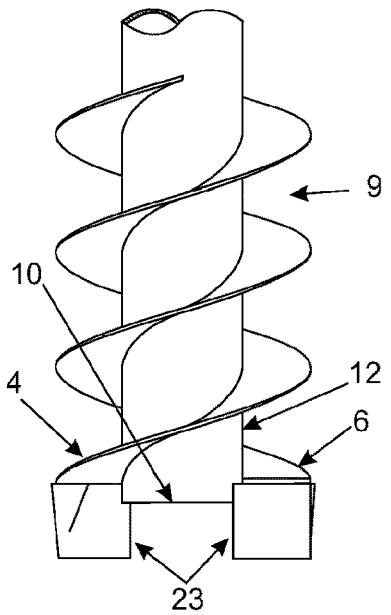
Figure 14:
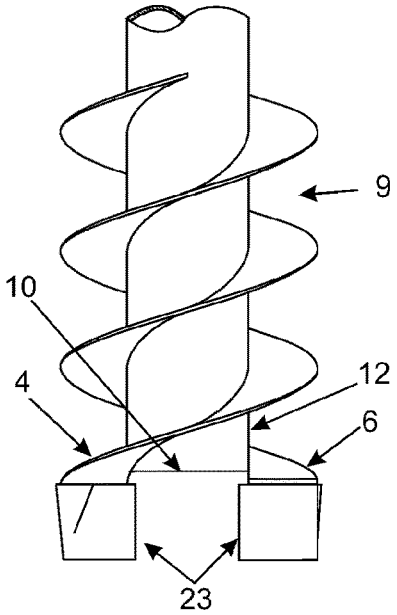

FIG. **6*a*** is a pictorial view of the outer drill only with the flights running in the opposite direction;

FIG. 7 is a plan view of the outer drill along the section B-B viewed in the direction of the arrows;

FIG. 8 is a plan view of the outer drill along the section B-B or Ba-Ba viewed in the direction of the arrows with the outer flights removed for clarity;

FIG. 9 is a plan view of a first variant of the outer drill along the section B-B viewed in the direction of the arrows;

FIG. 10 is a plan view of a second variant of the outer drill along the section B-B viewed in the direction of the arrows;

FIG. 11 is a plan view of a third variant of the outer drill along the section B-B viewed in the direction of the arrows;

FIG. 12 is a series of pictorial views ((i) to (iv)) of a preferred method of using the drill unit to form a stone column;

FIG. 13 is a pictorial view of an alternate variant of the outer drill;

FIG. 14 is a pictorial view of an alternate variant of the outer drill; and

Figure 4:
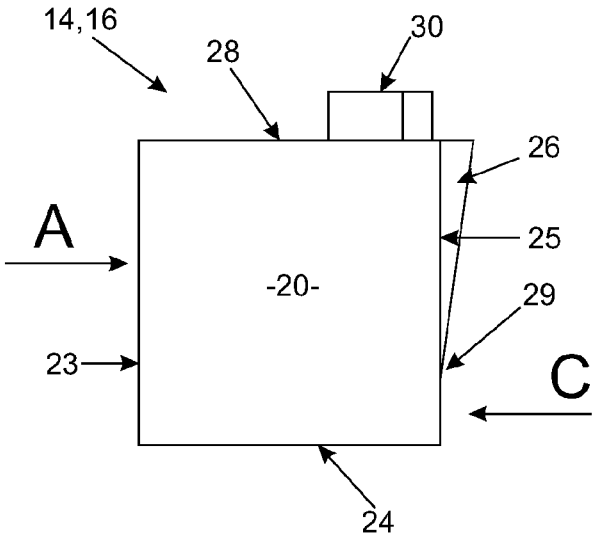
FIG. 4 is a front view of a first version of a drill tooth, with the first face facing the viewer.
Figure 15:
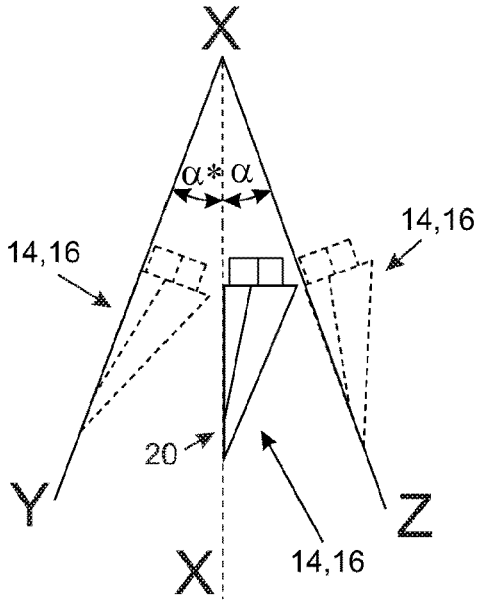
Figure 16:
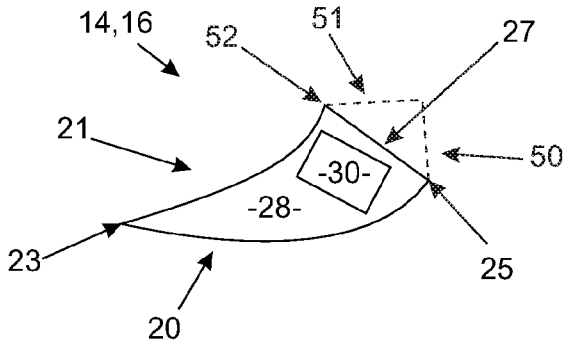
Figure 17:
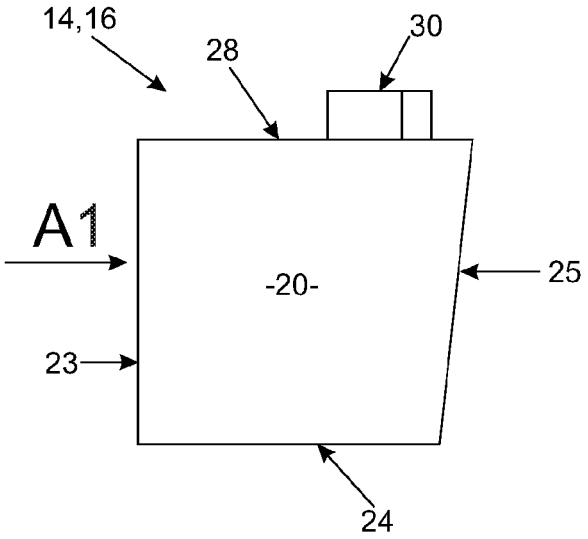
Figure 18:
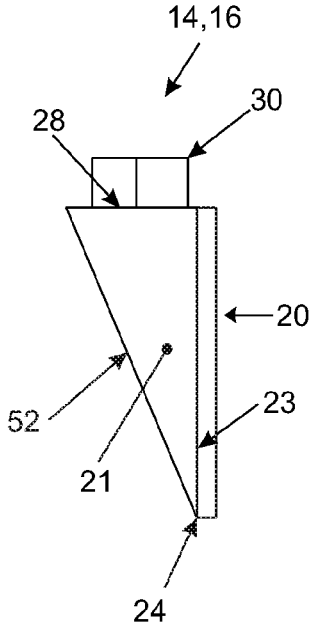
Figure 19:
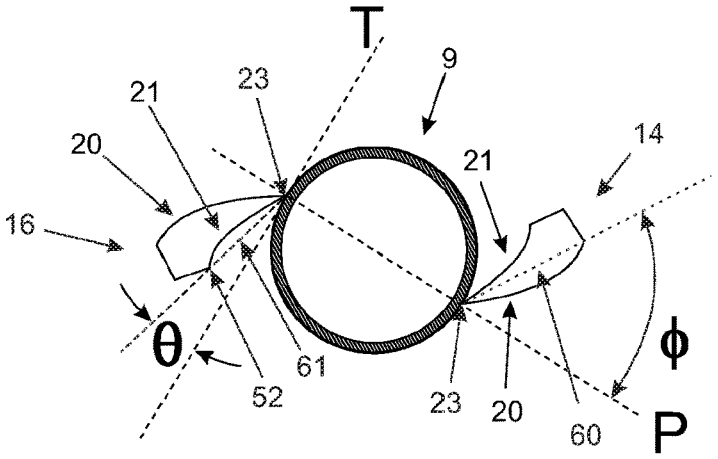
Figure 20:
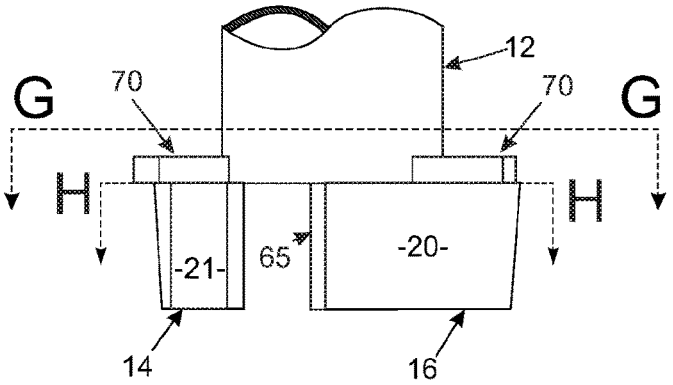
Figure 21:
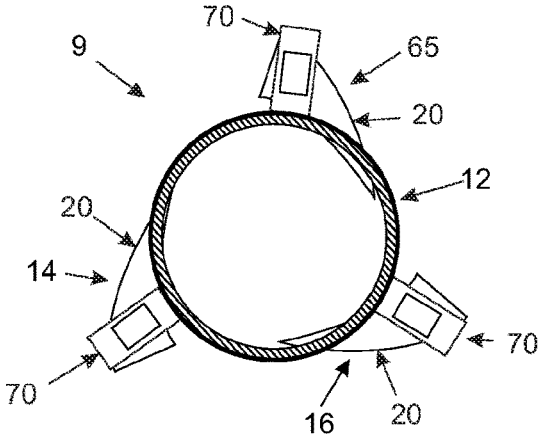
Figure 22:
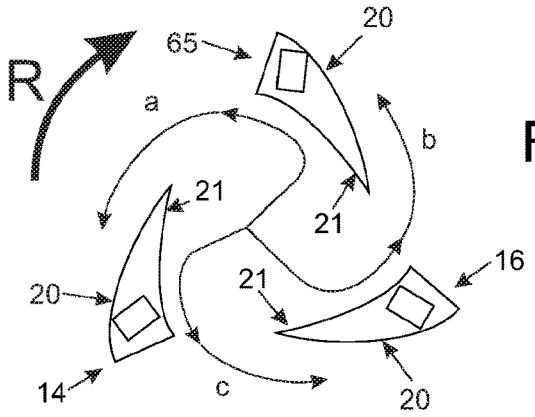
Figure 23:
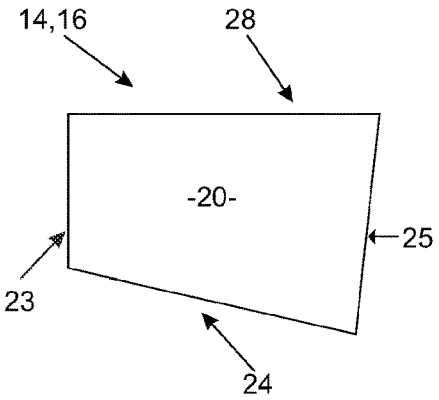
Figure 24:
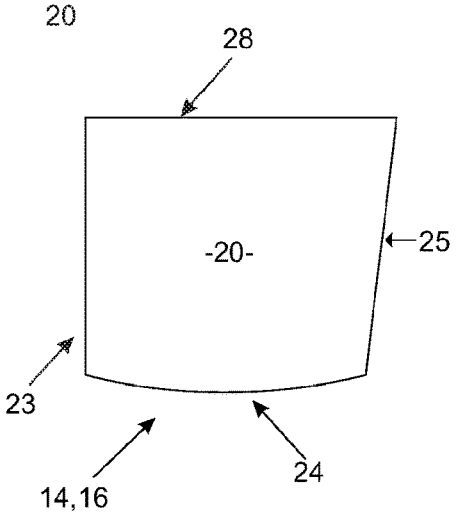
Figure 25:
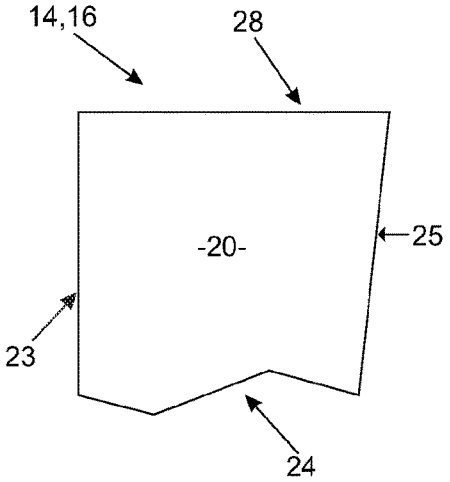
Figure 26:
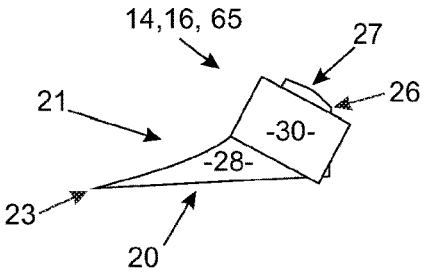

FIG. 15 is a side view, in the direction of arrow C on FIG. 4, of a drill tooth at various angles $\alpha$ from the longitudinal axis of the outer drill;

FIG. 16 is a top view of a second version of a drill tooth side;

FIG. 17 is a front view of a second version of a drill tooth, with the first face facing the viewer;

FIG. 18 is a side view of a first version of the drill tooth, the side view shown is in the direction of arrow A1 on FIG. 17;

FIG. 19 is a plan view of the outer drill along section B-B or section Ba-Ba viewed in the direction of the arrows, with the flights removed and the second form of the drill tooth shown;

FIG. 20 is a pictorial view of a portion of a second variant of the outer drill, where the second variant of the outer drill has no flights and each drill tooth is attached to an outrigger;

FIG. 21 is a plan view of the second variant along the section G-G viewed in the direction of the arrows;

FIG. 22 is a plan view of the second variant along the section H-H view in the direction of the arrows showing the flow of material when a column is being formed;

FIG. 23 is a front view of a drill tooth where the second edge is not parallel to the first terminal end;

FIG. 24 is a front view of a drill tooth where the second edge is curved;

FIG. 25 is a front view of a drill tooth where the second edge is a series of line segments and/or curves;

FIG. 26 is a plan view of a further variant where the connection plug extends beyond the periphery of the base (fifth face).

DEFINITIONS

Aggregate: when used herein is construction aggregate above about 0.1 mm in size (including sand, stones, crushed rock, crushed concrete, slag, etc).

Auger: when used herein is a flight attached to an elongate central member.

Column, when used herein includes a stone column or any other form of column formed in the ground to act as a support for any structure or simply to stabilise the ground.

Cylinder: when used herein is a closed solid that has two parallel bases connected by a curved surface, the bases may be circular, elliptical, hyperbolic or parabolic; and includes right and oblique cylinders.

Drill teeth: this is the plural of drill tooth and may be used when more than one drill tooth is present.

Edge: when used in relation to the leading edges (first and second edges for example) of the drill tooth may be up to 25 mm wide as they are the parts of the drill tooth that 'lead' the tooth through the ground and experience the most wear.

Flight: when used herein is a strip of material following a helical path like a spiral staircase.

Outside diameter: When referring to objects with a cross section that is not circular this is intended to mean the circle scribed by the longest line segment from the centre to the periphery of that object.

Stone column: when used herein this includes an un-bonded aggregate stone column, a bonded stone column, a concrete column, a column that varies in composition with depth (bonded/un-bonded, aggregate, aggregate+grout, concrete, or any combination of these). Un-bonded indicates that there is no grout or other adhesive bonding the aggregate together.

Tube: when used herein a tube is meant to indicate a long hollow member whose outer cross sectional profile may be circular or any other shape (triangular, rectangular, hexagonal, octagonal, etc) and whose inner cavity is circular (or approximately circular/elliptical) in cross section.

Please note the drawings are representative only and the relative dimensions may be exaggerated for clarity.

Where a range is provided it is intended to cover all sub ranges within that overall range.

BEST MODE FOR CARRYING OUT THE INVENTION

Figures 1, 2:
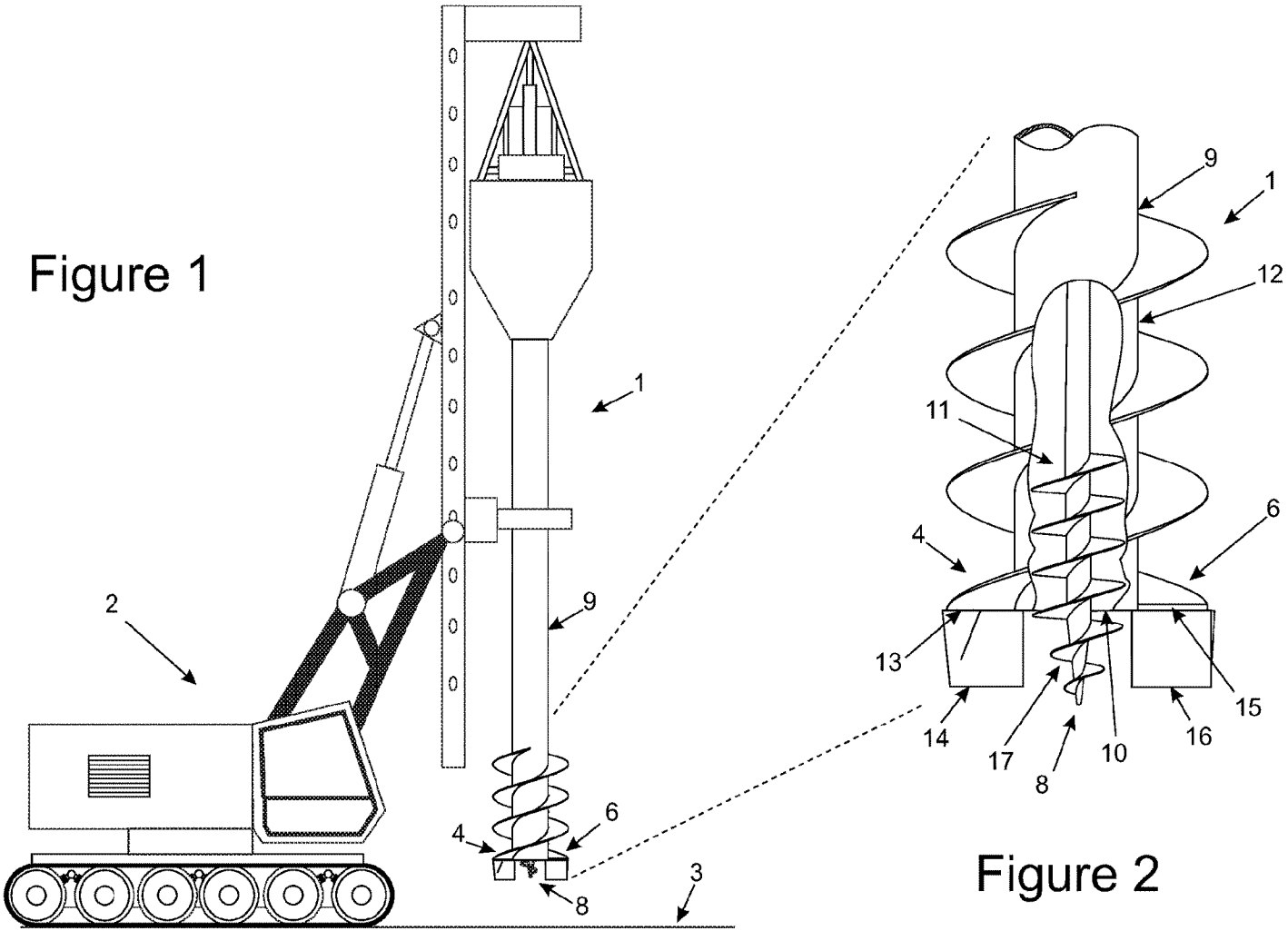
FIG. 1 is a side figurative view of the machine for forming granular columns mounted onto to a crane/excavator.
FIG. 2 is a side view of a portion of the drill unit with a portion of the outer drill removed.

Referring to FIG. 1 a drill unit (1) mounted to a crane or excavator (2) is shown with the excavator or crane (2) sitting on the ground (3). The drill unit (1) shown includes two outer flights (4,6), an inner drill (8) and an outer drill (9). Two outer flights (4,6) are shown as part of the outer drill (9) as twin start drills are standard in the industry, but, there could equally be one outer flight (4) or a plurality of outer flights (4,6), for example there could be 1, 2, 3, 4, 5, 6, 7 or more outer flights (4,6).

FIG. 2 shows an enlarged portion of the drill unit (1) partially cut away to reveal the inner drill (8) in more detail. Referring to FIG. 2 the outer drill (9) is shown as a tube which includes a first terminal end (10), a first cavity (11) and a first outside surface (12) where:

- the first terminal end (10) is the terminal end of the outer drill (9) that, when in use, enters the ground (3) first;
- the first cavity (11) is a longitudinal void within the outer drill (9) which has an open end coterminous with the first terminal end (10);
- the first outside surface (12) is the outer exposed surface of the outer drill (9) from which the outer flights (4,6) extend; and
- each outer flight (4,6) is a flight that extends along at least part of the length of the outer drill (9); each outer flight (4,6) makes one or more part or whole turns around the outer drill (9) in this length. With multiple outer flights (4,6) each may terminate at the same or a different distance from the first terminal end (10).

One end of each outer flight (4,6) terminates at an outer flight terminal end (13,15) located close to or at the first terminal end (10).

Attached close to, or at, each outer flight terminal end (13,15) is a drill tooth (14,16), the form of attachment can be permanent (welded, forged, integrally formed with the outer flight (4,6) or any other permanent attachment means known in the industry) or releasable (socketed into, including a plug that fits into a mating socket, keyed, riveted, pinned, bolted onto, screwed into or attached via screws, a combination of these, or any other releasable means known in the industry). The attachment may include a frangible and/or hinged connection link to minimise or prevent damage to a drill tooth (14,16) if in use it impacts essentially immovable material.

The inner drill (8) lies, at least partially, within the first cavity (11) and is co-axial with the outer drill (9).

Each drill tooth (14,16) is attached to the respective outer flight terminal end (13,15) in such a way as to enter the ground before that outer flight (4,6).

The inner drill (8) is an auger with an inner drill flight (17) which is a flight that extends at least partially along the length of the inner drill (8). In use the inner drill (8) can be moved longitudinally in relation to the outer drill (9), in addition, in use, the inner drill (8) can also be rotated in the same or an opposite direction, and at the same or a different rotational velocity as, the outer drill (9). The inner drill (8), when the drill unit (1) is in use, can assist in drilling the hole used to form a stone column and/or be used to feed aggregate, concrete, a mix of aggregate and grout, a mixture of concrete and aggregate or a mixture of concrete and grout to form the stone column as the drill unit (1) is extracted.

Figure 3:
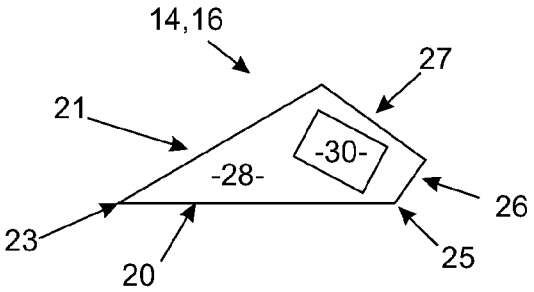
FIG. 3 is a top view of a first version of a drill tooth.
Figure 5:
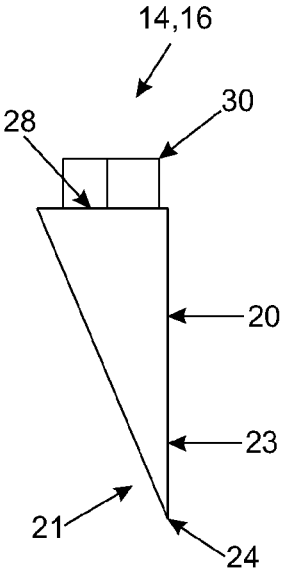
FIG. 5 is a side view of a first version of the drill tooth, the side view shown is in the direction of arrow A on FIG. 4.

Referring to FIGS. 3, 4 and 5 one version of the drill tooth (14,16) is shown in plan view, front view and side view respectively, the side view shown is the view in the direction of arrow A (FIG. 4). The drill tooth (14,16) shown includes:

- a first face (20) which is the leading face of the drill tooth (14,16) when the drill unit (1) (shown in FIGS. 1 and 2) is forming the stone column;
- a second face (21), which is immediately adjacent the first face (20) and, when the drill tooth (14,16) is attached to the outer flight (4,6) (shown in FIGS. 1 and 2), is the face closest to the first outside surface (12) (shown in FIGS. 1 and 2);

a first edge (23) which is the edge coterminous with the first face (20) and the second face (21), in use forming the column this is the leading edge of the first face (20) and second face (21);

a second edge (24) which, when the drill tooth (14,16) is attached to the outer drill (9), is the edge of the drill tooth (14,16) that enters the ground first, it is also an edge of the drill tooth (14,16) immediately adjacent the first edge (23);

a third edge (25) which is the edge of the first face (20) opposite the first edge (23) and adjacent the second edge (24), in use forming the column this is the trailing edge of the first face (20);

a third face (26) which is coterminous with the third edge (25) and immediately adjacent the first face (20);

a fourth face (27) which is the face immediately adjacent, and coterminous with, both the third face (26) and the second face (21);

a fifth face (28) which is essentially the base of the drill tooth (14,16) from which the other faces (20, 21, 26,27) extend; and a connection plug (30) which extends from the fifth face (28) in the opposite direction to the first, second, third and fourth faces (20,21,26,27).

The first face (20) is essentially planar and quadrilateral in shape, though it could be concave or convex if required. The third face (26) is essentially planar and triangular in shape aligned such the drill tooth (14,16) tapers (not necessarily evenly) from a widest point at the fifth face (28) to a vertex (29) lying on the third edge (25).

The first face (20), second face (21), third face (26) and fourth face (27) all extend away from and have at least one edge coterminous with the fifth face (28), and these are the only faces of the drill tooth (14,16).

The fourth face (27) blends into the second face (21) as you move away from the fifth face (28) towards the second edge (24).

The first face (20) and second face (21) co-terminate at both the first edge (23) and second edge (24) where these edges are thin. In this case, thin means that they have a thickness sufficient to make the edge robust in the environment in which it is used, as such it is likely that the first and second edges (23, 24) will fall in the range of 3 mm to 25 mm depending on the material used (in some configurations the drill tooth may be 3 m or longer in at least one dimension). The first edge (23), second edge (24), and third edge (25), possibly the third face (26), are likely to be wear surfaces of associated drill tooth (14,16) and as such may be replaceable, or include replaceable wear components.

The connection plug (30) is adapted to engage with a complementary feature in the outer drill (9) and attach the drill tooth (14,16) to the outer drill (9).

Figure 6:
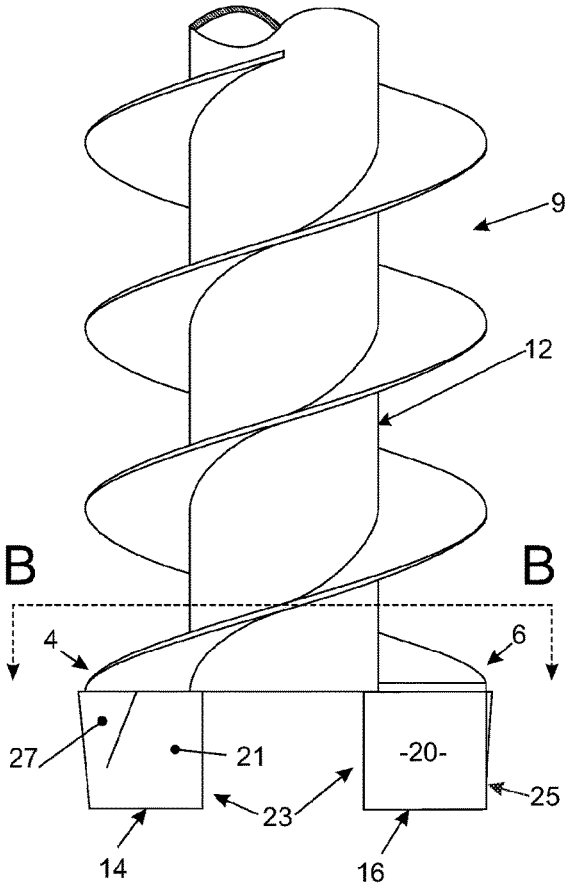
FIG. 6 is a pictorial view of a portion of the outer drill only.
Figure 6A:
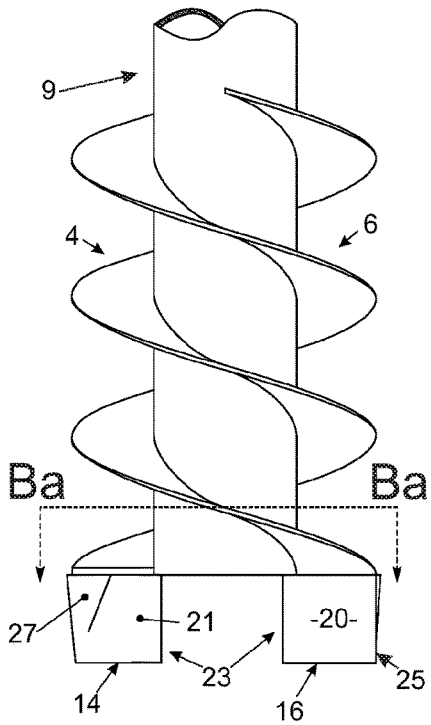

Referring to FIGS. 6 and 7 the outer drill (9) with a section line B-B, and that section when viewed in the direction of the arrows, respectively, are shown. FIG. 6*a* shows the outer drill (9) with the outer flights (4,6) running in the opposite direction so that during insertion of the drill unit (1) into the ground the first edge (23) trails the third edge (25). In FIG. 8 the sectional view of FIG. 7, and the sectional view of the variant shown in FIG. 6*a* along the section line Ba-Ba, are shown without the outer flights (4, 6) present so that the important angles between the faces of the drill tooth (14,16) and the first outside surface (12) are visible.

In FIGS. 7 and 8 the first face (20) is shown as lying on a plane parallel to the longitudinal axis of the drill unit (1), this need not be the case, the first face (20) may be angled in relation to the longitudinal axis of the drill unit (1).

In the views shown in FIGS. 7 and 8, which are sectional plan views, the first edge (23) of each drill tooth (14,16) is shown close to or touching the first outside surface (12) with a perpendicular (P) and tangent (T) to the first outside surface (12) at that point shown as dashed lines. Each drill tooth (14,16) extends from the first terminal end (10) and as such the first edge (23) may not be physically, immediately, adjacent, or touching, the first outside surface (12), though it some portion of it may. The first edge (23) of each drill tooth (14,16) is the leading edge of that drill tooth (14,16) when it is in use, and is shown circumferentially leading the outer flight terminal end (13,15).

The angle between the perpendicular (P) and the first face (20) is $\phi$ which is preferably from 15° to 80°, and the angle between the second face (21), where the second face (21) is coterminous with the fifth face (28), and the tangent (T) is $\theta$ which is preferably 1° to 10°. The angular range for $\phi$ can be any subset of the range given, with any start or finish point, for example 15° to 45°, 45° to 80°, basically the first angle of the range can be from 15° to 79° and the second angle given can be anything from 16° to 80°.

The angle, $\phi$, of the first face (20) relative to the outer drill (9) will depend on the material (35) being fed, the ground (3) properties and the properties of the required stone column (45).

Referring to FIGS. 9, 10 and 11 three alternative variants are shown, these views are similar to FIG. 7 as they are cross-sectional views of the outer drill (9) along the line B-B in the direction of the arrows. Each of the variants shown in FIGS. 9 to 11 are different but, they all show an outer drill (9) with one outer flight (4) a first outer flight (4), with the hidden portions of the single drill tooth (14) associated with the first outer flight (4), the first drill tooth (14), shown as dashed lines. In FIG. 9 the third face (26) extends beyond the peripheral edge (31) of the first outer flight (4). In FIG. 10 the second face (21) is shown wholly within an arc scribed by the peripheral edge (31) of the first outer flight (4). In FIG. 11 the second face (21) is shown aligned with the peripheral edge (31) of the first outer flight (4).

In FIGS. 9 to 11 a socket (32) is shown attached to the outer flight terminal end (13) associated with the first outer flight (4), the first outer flight terminal end (13), such that the first drill tooth (14) is aligned at the required angles of $\phi$ and $\theta$ once the connection plug (30) is inserted into the connection socket (32). To hold the connection plug (30) into the connection socket (32), a pin may be inserted. It should be noted that the connection plug (30) and the connection socket (32) are industry standard components and they are shown merely as one possible method of attachment.

One preferred method of using the drill unit (1) with a drill tooth (14,16) is shown in FIG. 12 as steps (i), (ii), (iii); only the drill unit (1) in the ground is shown without the excavator/crane or other ancillary equipment for clarity.

In step (i) the drill unit (1) is inserted into the ground (3) until it reaches the desired depth.

In step (ii) the inner drill (8) is moved longitudinally within the drill unit (1) so that it extends further from the first terminal end (10) than in step (i).

In step (iii) the material (35) required to form the stone column is fed into the second terminal end (40) of the outer drill (9) to move through the first cavity (11) and exit out of the first terminal end (10). The second terminal end (40) is the terminal end of the outer drill (9) that is the opposite terminal end of the first terminal end (10).

In step (iv) the drill unit is withdrawn with both the inner drill (8) and outer drill (9) rotating, the inner drill (8) is rotated so that it feeds material out of the first terminal end (10). During this step each drill tooth (14,16) assists the material (35) radially outwardly to reduce the chance that some of the material (35) will move against the general direction of flow of the material (35). It is also believed that the movement of the drill tooth (14,16) through the ground (3) acts to reduce the pressure close to the second face (21) allowing the material (35) to be more easily fed from the cavity (11). This material (35) fed in behind the second face (21) then interacts with the first face (20) of the following drill tooth (14,16) which guides this material (35) away from the centre of the drill unit (1) allowing additional material (35) to be more easily fed. As the drill unit is removed and the material (35) is fed along the first cavity (11) drill unit (1) a stone column (45) is formed.

Referring to FIG. 13, a variant of the outer drill (9) is shown, in this variant the outer flight (4,6) terminates before the first terminal end (10), this allows a section of the first edge (23) to touch or be immediately adjacent the first outside surface (12).

Referring to FIG. 14, a further variant of the outer drill (9) is shown, in this variant the outer flight (4,6) terminates beyond the first terminal end (10).

FIG. 15 shows an alternate side view of a drill tooth (14,16), in the direction of arrow C on FIG. 4. FIG. 15 shows the first face (20) parallel to a dashed line labelled X-X to show one orientation of the drill tooth (14,16), two additional lines (X-Y and X-Z) with dashed representations of the drill tooth (14,16) show the range of angles the first face (20) can be angled to a line parallel to the longitudinal axis of the outer drill (9). The two lines X-Y and X-Z are at an angle of $\alpha$ or $\alpha^*$ respectively, where the angle $\alpha$ or $\alpha^*$ can be up to +45° and −45° respectively, though it is likely to be less than this. For conciseness we will refer to an angle $\alpha$ which can be any angle from −45° to +45° from a line parallel to the longitudinal axis of the outer drill (9). To ensure clarity the angular range for a can have any start angle from −45° to +45°, and any final angle from the −45° to +45°, for example −5° to 5°, −5° to 10°, −6° to 5°, 10° to 10°, −34° to 5°, −30° to 30°, −45° to −25°, 25° to 45° etc.

It should be noted that as the size of drill units (1) can be anything from very small (a diameter of around 100 mm or even less) to many meters in diameter, and as such the drill tooth (14,16) may be a single unit (as shown in FIGS. 1 to 14) or made up or a plurality of smaller sub-units. This wide range of sizes also means that the distance the drill tooth (14,16) extends from the first terminal end (10) relative to the width of the outer flight (4,6) may vary from that shown.

Referring to FIGS. 16 to 18 a second form of a drill tooth (14,16) is shown in plan view, front view and side view respectively, the side view shown is the view in the direction of arrow A1. This second form of the drill tooth (14,16) has a curved first face (20), a curved second face (21), a fourth or alpha face (27) and a fifth or connector face (28) which are the outermost faces of the drill tooth (14,16).

Referring to FIG. 16, which is the plan view of the drill tooth (14,16), the first face (20) is shown as a convex curve and the second face (21) is shown as a concave curve. In the side views the first face (20) and second face (21) are shown as essentially straight, this is because in this second form these faces curve in only one plane. To put this another way, in this second form of the drill tooth (14,16) the first face (20) and second face (21) are shown as portions of the surface of a cylinder.

It is believed that the movement of each drill tooth (14,16) through the ground during the column formation stage creates a low pressure zone. It is believed that this low pressure zone, if formed, then acts to reduce the fluid ground pressure which improves the feed rate and/or feed rate consistency of the material and improve the quality of the column formed.

The alpha face (27) may consist of one or more sub-faces (50,51) shown as dashed lines on FIG. 16. In this case the first edge (23) is the edge coterminous with the first and second faces (20,21), and the third edge (25) is the edge coterminous with the first and alpha faces (20,27). The fourth edge (52) is the edge coterminous with the alpha face (27) and the second face (21).

Referring to FIG. 19, which is a cross sectional view similar to that shown in FIG. 8, but showing the second form of the drill tooth (14,16), the second form of the drill tooth (14,16) is shown in relation to the outer drill (9). In FIG. 19 the angle between the perpendicular (P) and a dashed line, the first line (60), drawn between the first edge (23) and third edge (25) is $\phi$, which is preferably from 15° to 80°, and the angle between a dashed line, the second line (61), drawn between the first edge (23) and the fourth edge (52) and the tangent (T) is $\theta$, which is preferably 1° to 10°. The angles shown in FIG. 19 may be exaggerated for clarity.

Referring to FIGS. 20 and 21 a second variant of the outer drill (9) is shown, in this variant there are no flights attached to the first outside surface (12), and each drill tooth (14,16, 65) is attached (releasably or permanently, or semi-permanently) to an outrigger (70). Each outrigger (70) is a piece of material extending from the first outside surface (12). The three outriggers (70) are shown equispaced around the circumference of the outer drill (9) but the number and spacing may be varied to accomplish specific goals in some variants. One drill tooth (14,16,65) is shown attached to each outrigger (70) but in some configurations more than one drill tooth may be attached to each outrigger (70) and the configuration of each drill tooth (14,16,65) may be different (e.g. the first face (20) on one may be planar, the first face (20) on the second convex and the first face (20) on the third concave)

Referring to FIG. 22, which is a plan view similar to FIG. 8, 19 or 21, each drill tooth (14,16, 65) is shown as the second form of the drill tooth (14,16,65) but could equally be the first variant. FIG. 22 shows only each drill tooth (14,16, 65) without the outer drill (9), outer flights (4,6) or outriggers (70) when the drill unit (not shown) is in use forming a column. The arrows a, b and c show the flow of material (35) out from the first cavity (not shown), the arrow R indicates the direction the drill unit (not shown) rotates when forming the column (not shown). The movement of each drill tooth (14,16, 65) is believed to lower the pressure on the second face (21) allowing the material (35) to more easily exit the cavity (not shown) and flow outwards to form the column (not shown). The material (35) is believed to move out behind the second face (21) of one drill tooth (14,16, 65) and then along the first face (20) of the next drill tooth (14,16, 65) as drill unit (not shown) rotates. FIG. 22 is believed to show the path of material (35) for any of the inventions variants.

FIG. 16 can also be a plan view of a further form of the drill tooth (14,16) where the first face (20) and second face (21) are curved in two or three planes, making them convex or concave in more than one dimension.

It should be noted that even though the first edge (23) is described as a leading edge, this is when the drill unit (1) is being used to form the column (45) and as shown in FIGS.

6*a*, 8, 19 and 22 it may in fact be the trailing edge as the drill unit (1) is inserted into the ground.

FIGS. 23 to 25 show a series of drill tooth (14,16) variants with the first face (20) facing towards the viewer where the second edge (24) is not a straight line parallel to the first terminal end (10). In FIG. 23 the second edge (24) is linear but not parallel to the first terminal end (10), in FIG. 24 the second edge (24) is a convex curve (it could equally be a concave curve) and in FIG. 25 the second edge (24) is a series of short line segments (any of which could be a curve). It should be noted that the second edge (24) could angle either way with respect to the first edge (23) in FIG. 23, and the shape of the curve or number and relative lengths of the line segments in FIGS. 24 and 25 respectively are indicative only. The connection socket (30) is not shown as it is not always present (see FIG. 26 for a tooth with a connection socket), it is optional.

It should be noted that when forming a hole the end of the first cavity (11) at the first terminal end (10) may be capped to avoid ground or other material migrating into the first cavity (11), the caps being dislodged/withdrawn when material passes through the first cavity (11).

Referring to FIG. 26 a further variant of a drill tooth (14,16,65) where the connection plug (30) extends beyond the peripheral edges of the fifth face (28). In the variant shown the second face (21) and fourth or alpha face (27) are shown curved, they could equally be straight lines at the fifth face (28). Similarly the first face (20) is shown as straight lines, it could also be curved. The size of the connection plug (30) relative to the fifth face (28) is not critical as the connection plug (30) is simply dimensioned to attach the drill tooth (14,16,65) to the outer drill (9) (see FIG. 21 for example) or outer flight (4,6) (see any of FIGS. 9 to 11 for example).

For the avoidance of doubt any face of the tooth (14,16) (see any of FIGS. 1 to 26) can be curved (convex or concave) in one or more dimensions as such lines joining the edges of a particular face at the fifth face (28) (or base) of the tooth (14,16,65) are used to define the angles It is preferred that, where an outer flight (4,6) is present, see any one of FIG. 1,2, or 6-14, the drill tooth (14,16) attached to, or associated with, that flight (4,6), in the angled position, extends at least 50% of the full width of the outer flight (4,6). Where an outer flight (4,6) is not present, see FIG. 20 or FIG. 21 for example, then the length of the first face (20) is, where D is the diameter of the outer drill (9):

for an outer drill (9) up to 500 mm in diameter, a minimum of 0.2 D and a maximum of 1.5 D; and for an outer drill (9) over 500 mm, a minimum of 200 mm and a maximum of 0.5 D.

Noting that for outer drills (9) below 250 mm the minimum length of the first face (20) may be 0.33 D to 0.6 D rather than 0.2 D. These ranges may be narrowed to have a minimum anywhere within the range given and a maximum, greater than the minimum, anywhere within the range given.

It is also preferred (see FIG. 2) that the longitudinal separation between the first terminal end (10) and the second edge (16) is:

for an outer drill (9) diameter, D, of up to 500 mm from 0.2 D to 500 mm, and for an outer drill (9) diameter, D, over 500 mm between 100 mm and D.

Noting that for outer drills (9) below 250 mm the minimum longitudinal separation may be 0.33 D to 0.6 D rather than 0.2 D. These ranges may be narrowed to have a minimum anywhere within the range given and a maximum, greater than the minimum, anywhere within the range given.

The use of 'any angular range within this range' indicates that the start angle can be any value within the range given and the final angle can be any angle within the range given, and that specific range of angles is included and supported.

KEY

1. Drill unit
2. Crane or excavator,
3. Ground;
4. First outer flight;
6. Second outer flight;
8. Inner drill;
9. Outer drill;
10. First terminal end (of outer drill);
11. First cavity (of outer drill);
12. First outside surface (of outer drill);
13. First Outer flight terminal end;
14. First drill tooth
15. Second Outer flight terminal end;
16. Second drill tooth;
17. Inner drill flight;
20. First (leading) face;
21. Second face;
23. First edge;
24. Second edge;
25. Third edge;
26. Third face;
27. Fourth, or alpha, face;
28. Fifth (connector or base) face;
29. Vertex, a vertex of the third face;
30. Connection plug;
31. Peripheral edge, of the outer flight;
32. Connection Socket, for the connection plug;
35. Material used to form the column;
45. Stone column (when aggregate is used);
50. Sub-face;
51. sub-face;
52. fourth edge;
60. first line (line joining first edge and third edge);
61. second line (line joining the first edge and the fourth edge);
65. Third drill tooth;
70. outrigger $\phi$ angle between a perpendicular extending from the outer surface of the outer drill and a line, a first face alignment line, extending between the leading and trailing edges of the first face where the first face is coterminous with the fifth/base/connector face;

$\alpha$ the angle between a line parallel to the longitudinal axis of the outer drill and a plane lying on both the first face alignment line, and a line extending between the leading and trailing edges of the first face where the leading and trailing edges are coterminous with the second edge;

$\theta$ angle between a tangent to the outer surface of the outer drill and a line, a second face alignment line, extending between the leading and trailing edges of the second face where the second face is coterminous with the fifth/base/connector face;

The invention claimed is:

1. A drill unit for forming a column in ground which includes an outer drill, where:

the outer drill is a tube which includes a first cavity, a first outside surface and a first terminal end;

the first cavity is an interior void extending along the outer drill which, in use, provides a pathway for material used to form the column to exit at the first terminal end;

the first outside surface is an exposed outer surface of the outer drill; and the first terminal end of the outer drill is the terminal end of the outer drill that, when the drill unit is in use, enters, or is within, the ground;

such that attached to the outer drill there is at least one drill tooth which includes a first face, a second face and a base face wherein:

the first face and the second face are immediately adjacent one another and are coterminous at a first edge and a second edge;

the base face is the face closest to, or coterminous with, the first terminal end;

all faces, except the base face, are independently coterminous with the base face; and extend away from the base face in the same direction;

at least part of the at least one drill tooth extends away from the first terminal end to terminate at the second edge;

the second edge is the edge of the at least one tooth that is most longitudinally distant from the first terminal end;

the first face further includes a first alpha edge, where the first alpha edge is an edge of the first face opposite the first edge;

a line joining the first edge and the first alpha edge, where the first face and the base face are coterminous, a first face alignment line, is at an angle of to a perpendicular extending from the first outside surface;

the second face further includes a second alpha edge which is an edge of the second face opposite the first edge; and a line joining the first edge and the second alpha edge, where the second face and the base face are coterminous, a second face alignment line, is at an angle of θ to a tangent on the first outside surface;

such that, when in use forming the column, the first edge is configured to be a leading edge, and said at least one drill tooth moves material used to form the column radially outwards from the outer drill.

2. The drill unit as claimed in claim 1 wherein, there are at least two drill teeth.

3. The drill unit as claimed in claim 1 wherein, the at least one tooth is attached to an outer flight, where the outer flight is attached to the first outside surface.

4. The drill unit as claimed in claim 3 wherein, the drill tooth associated with a specific outer flight extends at least 50% of the full width of that outer flight.

5. The drill unit as claimed in claim 1 wherein, the length of the first face is, where D is the diameter of the outer drill:

for an outer drill up to 500 mm in diameter, a minimum of 0.2D and a maximum of 1.5D; and for an outer drill over 500 mm, a minimum of 200 mm and a maximum of 0.5D.

6. The drill unit as claimed in claim 1 wherein, the at least one drill tooth is attached to an outrigger, where the outrigger is attached to the first outside surface.

7. The drill unit as claimed in claim 1 wherein, when in use, the first edge is a leading edge of the drill tooth as the drill unit is inserted.

8. The drill unit as claimed in claim 1 wherein, the first face lies on a plane parallel to a longitudinal axis of the outer drill.

9. The drill unit as claimed in claim 1 wherein, the first face and/or the second face is planar.

10. The drill unit as claimed in claim 1 wherein, the first face and/or the second face is curved in at least one dimension.

11. The drill unit as claimed in claim 1 wherein, the first face lies on a plane which is at an angle α to a line parallel to a longitudinal axis of the outer drill, such that the angle α is between 45° and −45°.

12. The drill unit as claimed in claim 1 wherein, ϕ is from 15° to 80°.

13. The drill unit as claimed in claim 1 wherein, θ is from 1° to 10°.

14. The drill unit as claimed in claim 1 wherein, the drill unit includes an inner drill lying at least partially within the first cavity.

15. The drill unit as claimed in claim 14 wherein, the inner drill is an auger with an inner flight, where the inner flight is an auger flight.

16. A drill tooth for use with a drill unit where the drill tooth includes a first face, a second face and a base face such that:

the first face and the second face are immediately adjacent one another and are coterminous at a first edge and a second edge;

all faces, except the base face, are independently coterminous with the base face; and extend away from the base face in the same direction;

the second edge is the edge of the drill tooth most longitudinally distant from the base face;

the first face includes a first alpha edge where the first alpha edge is an edge of the first face opposite to the first edge;

the drill tooth further includes a first face alignment line which is a line joining the first edge and the first alpha edge where the first face and the base face are coterminous;

the second face includes a second alpha edge which is an edge of the second face opposite the first edge;

the drill tooth further includes a second face alignment line which is a line joining the second alpha edge and the first edge where the second face and the base face are coterminous;

the first face is planar or convex;

the second face is planar or concave; and the angle between the first face alignment line and the second face alignment line is a minimum of 0° and a maximum of 74°.

17. The drill tooth as claimed in claim 16 wherein, the base face is a quadrilateral with zero or more curved edges.

18. The drill tooth as claimed in claim 16 wherein, the first and/or second face is curved in at least one dimension.

19. The drill tooth as claimed in claim 16 wherein, there are one or more faces between the first alpha edge and the second alpha edge.

* * * * *